US008011175B2

(12) United States Patent
Husges et al.

(10) Patent No.: US 8,011,175 B2
(45) Date of Patent: Sep. 6, 2011

(54) EXHAUST-GAS COOLING DEVICE FOR AN INTERNAL COMBUSTION ENGINE

(75) Inventors: Hans-Jurgen Husges, Willich (DE); Hans-Ulrich Kuhnel, Monchengladbach (DE)

(73) Assignee: Pierburg GmbH, Neuss (DE)

( * ) Notice: Subject to any disclaimer, the term of this patent is extended or adjusted under 35 U.S.C. 154(b) by 343 days.

(21) Appl. No.: 12/193,491

(22) Filed: Aug. 18, 2008

(65) Prior Publication Data

US 2009/0044525 A1 Feb. 19, 2009

(30) Foreign Application Priority Data

Aug. 17, 2007 (DE) ..... 10 2007 038 882

(51) Int. Cl.
*F02M 25/07* (2006.01)

(52) U.S. Cl. ..... 60/278; 60/320

(58) Field of Classification Search ..... 60/296, 60/320, 321, 278; 123/568.12, FOR. 126; 137/625.21, 625.43
See application file for complete search history.

(56) References Cited

U.S. PATENT DOCUMENTS 4,543,996 A * 10/1985 Baron ..... 137/625.43

FOREIGN PATENT DOCUMENTS

| | | | |
|---|---|---|---|
| DE | 10 2004 019 554 | A1 | 11/2005 |
| DE | 103 55 649 | A1 | 12/2005 |
| DE | 10 2005 006 055 | A1 | 8/2006 |
| DE | 20 2006 009 464 | U1 | 10/2006 |
| DE | 102007002459 | A1 | 7/2007 |
| EP | 0 987 427 | A1 | 3/2000 |
| FR | 2891590 | A | 4/2007 |
| FR | 2891590 | A1 * | 4/2007 |
| WO | 2007/039700 | A1 | 4/2007 |
| WO | 2007/039701 | A1 | 4/2007 |
| WO | 2008/101560 | A1 | 8/2008 |

* cited by examiner

*Primary Examiner* — Thomas E Denion
*Assistant Examiner* — Jonathan Matthias
(74) *Attorney, Agent, or Firm* — Griffin & Szipl, P.C.

(57) ABSTRACT

An exhaust-gas cooling device for an internal combustion engine includes a housing with an exhaust-gas inlet, an exhaust-gas outlet, a valve device, and a U-shaped heat exchange unit including an outbound flow path and a return flow path. The housing comprises, on the open side of the U-shaped heat exchange unit, a first, a second and a third chamber. The first chamber provides a fluid connection from the exhaust-gas inlet to the second chamber, and the third chamber provides a fluid connection from the second chamber to the exhaust-gas outlet. The valve device is arranged in the second chamber such that the second chamber can be divided into two partial chambers, a first one of the partial chambers is arranged in fluid connection with the outbound flow path, and the second one of the partial chambers is arranged in fluid connection with the return flow path.

6 Claims, 2 Drawing Sheets

EXHAUST-GAS COOLING DEVICE FOR AN INTERNAL COMBUSTION ENGINE

This application claims priority from Patent Application No. 10 2007 038 882.0, filed Aug. 17, 2007, the entire disclosure of which is incorporated herein by reference.

FIELD OF THE INVENTION

The present invention relates to an exhaust-gas cooling device for an internal combustion engine, wherein the exhaust-gas cooling device comprises a housing with an exhaust-gas inlet, an exhaust-gas outlet, a valve device, and a U-shaped heat exchange unit including an outbound flow path and a return flow path.

BACKGROUND OF THE INVENTION

An exhaust-gas cooling device of the above type is known from DE 10 2004 019 554 A1. In the embodiment illustrated in the document, the hot exhaust gas is first is fed into a so-called heat exchanger, and the heat exchanger comprises ribs extending in the flow direction and intended to provide an improved heat transition between the exhaust gas and the coolant. During the flow of the exhaust gas through this heat exchanger, the heat exchanger will be susceptible, along with the increasing temperature of the exhaust gas, to sooting and char depositions so that the flow through the heat exchanger will be impeded. The sooting tends to occur particularly in the return flow path of the U-shaped heat exchanger because, in that stretch of the path, the exhaust gas has already been considerably cooled. In an effort to accomplish an improved heat transition while at the same time reducing the sooting, further prior art documents, e.g. DE 20 2006 009 464 U1, have proposed to select a special arrangement of the ribs and/or a special shape of the ribs. However, none of these approaches have been found useful for basically preventing the sooting throughout the operating life of the heat exchanger.

Thus, it is an object of the invention to provide an exhaust-gas cooling device which is adapted to still further reduce the sooting in the heat exchanger unit, while effecting the reduction at the lowest possible expenditure for production and the lowest possible costs.

SUMMARY OF THE INVENTION

The above object is achieved in that the housing comprises, on the open side of the U-shaped heat exchange unit, a first, a second and a third chamber, wherein the first chamber provides a fluid connection from the exhaust-gas inlet to the second chamber, and the third chamber provides a fluid connection from the second chamber to the exhaust-gas outlet, wherein the valve device is arranged in the second chamber such that the second chamber can be divided into two partial chambers, wherein a first one of the partial chambers is arranged in fluid connection with the outbound flow path, and the second one of the partial chambers is arranged in fluid connection with the return flow path. In this manner, there is provided an exhaust-gas cooling device wherein, by simple actuation of the valve device, the direction of the flow through the U-shaped heat exchange unit can be quickly changed to the effect that the "cold" part of the heat exchange unit, i.e. the return flow path, will be subjected to hot exhaust gas and thus be cleaned.

According to a preferred embodiment, the valve device is configured as a centrally supported flap valve, with one flap being operatively connected to part-circular outer surfaces of the first and third chambers. In this manner, there is obtained an exhaust-gas cooling device that can be assembled in a particularly simple manner. In this regard, it is also advantageous if the housing consists of two housing halves, a first one of the housing halves accommodating the heat exchange unit and the second housing half having the valve device supported therein.

The present invention further relates to an exhaust-gas recirculation system provided with an exhaust-gas cooling device, wherein a bypass channel bypassing the heat exchange unit, and an exhaust-gas recirculation valve device are provided. In the system, the bypass channel can be provided separately from the exhaust gas cooling device or, as still to be described hereunder, be integrated into the device. The exhaust-gas recirculation valve is arranged upstream or downstream of the exhaust-gas cooling device in a known manner and is provided to control the quantity of the exhaust gas to be recirculated. With particular advantage, the bypass channel can be formed in the flap of the valve device.

As part of the present invention, there is further claimed a method for cleaning a U-shaped heat exchange unit of an exhaust-gas recirculation system wherein, in the cleaning mode, the return flow path is connected to an exhaust-gas inlet of the heat exchange unit, whereby the flow direction of the exhaust gas through the heat exchange unit is reversed such that a return flow path of the heat exchange unit is subjected to hot exhaust gas.

Thus, in accordance with a first illustrative embodiment of the invention, an exhaust-gas cooling device for an internal combustion engine is provided, wherein the exhaust-gas cooling device includes a housing (2) provided with an exhaust-gas inlet (3), an exhaust-gas outlet (4), a valve device (5), and a U-shaped heat exchange unit (6) including an outbound flow path (7) and a return flow path (8), wherein the housing (2) comprises, on the open side of the U-shaped heat exchange unit (6), a first (9), a second (10) and a third chamber (11), wherein the first chamber (9) provides a fluid connection from the exhaust-gas inlet (3) to the second chamber (10), and the third chamber (11) provides a fluid connection from the second chamber (10) to the exhaust-gas outlet (4), wherein the valve device (5) is arranged in the second chamber (10) so that the second chamber (10) can be divided into two partial chambers (17; 18), wherein a first one (17) of the partial chambers (17; 18) is arranged in fluid connection with the outbound flow path (7), and the second one (18) of the partial chambers (17; 18) is arranged in fluid connection with the return flow path (8). In accordance with a second illustrative embodiment of the invention, the first illustrative embodiment is modified so that the valve device (5) is configured as a centrally supported flap valve, with one flap (23) that is operatively connected to part-circular outer surfaces (21,22) of the first and third chambers (9,11). In accordance with a third illustrative embodiment of the present invention, the first illustrative embodiment is modified so that the housing comprises two housing halves (12,13), wherein a first one of the housing halves (12,13) accommodates the heat exchange unit (6) and the second one of the housing halves (12,13) has the valve device (5) supported therein.

In accordance with a fourth illustrative embodiment of the invention, the first illustrative embodiment is modified so that a bypass channel (20) bypassing the heat exchange unit (6) is provided, and so that an exhaust-gas recirculation valve device (5) is provided. In accordance with a fifth illustrative embodiment of the invention, the fourth illustrative embodiment is further modified so that the bypass channel (20) is arranged in the flap (23) of the valve device (5). In accordance with a sixth illustrative embodiment of the present invention, the fourth illustrative embodiment is further modified so that the bypass channel (20) is arranged in the flap (23) of the flap valve (5).

In accordance with a seventh embodiment of the present invention, a method for cleaning a U-shaped heat exchange unit of an exhaust-gas recirculation system is provided, wherein, in the cleaning mode, the return flow path (8) is connected to an exhaust-gas inlet (3) of the U-shaped heat exchange unit (6), whereby the flow direction of the exhaust gas through the U-shaped heat exchange unit (6) is reversed so that the return flow path (8) of the U-shaped heat exchange unit (6) is subjected to hot exhaust gas.

A preferred embodiment of the invention will be described in greater detail as follows with reference to the accompanying drawings.

DETAILED DESCRIPTION OF A PREFERRED EMBODIMENT

Figure 1:
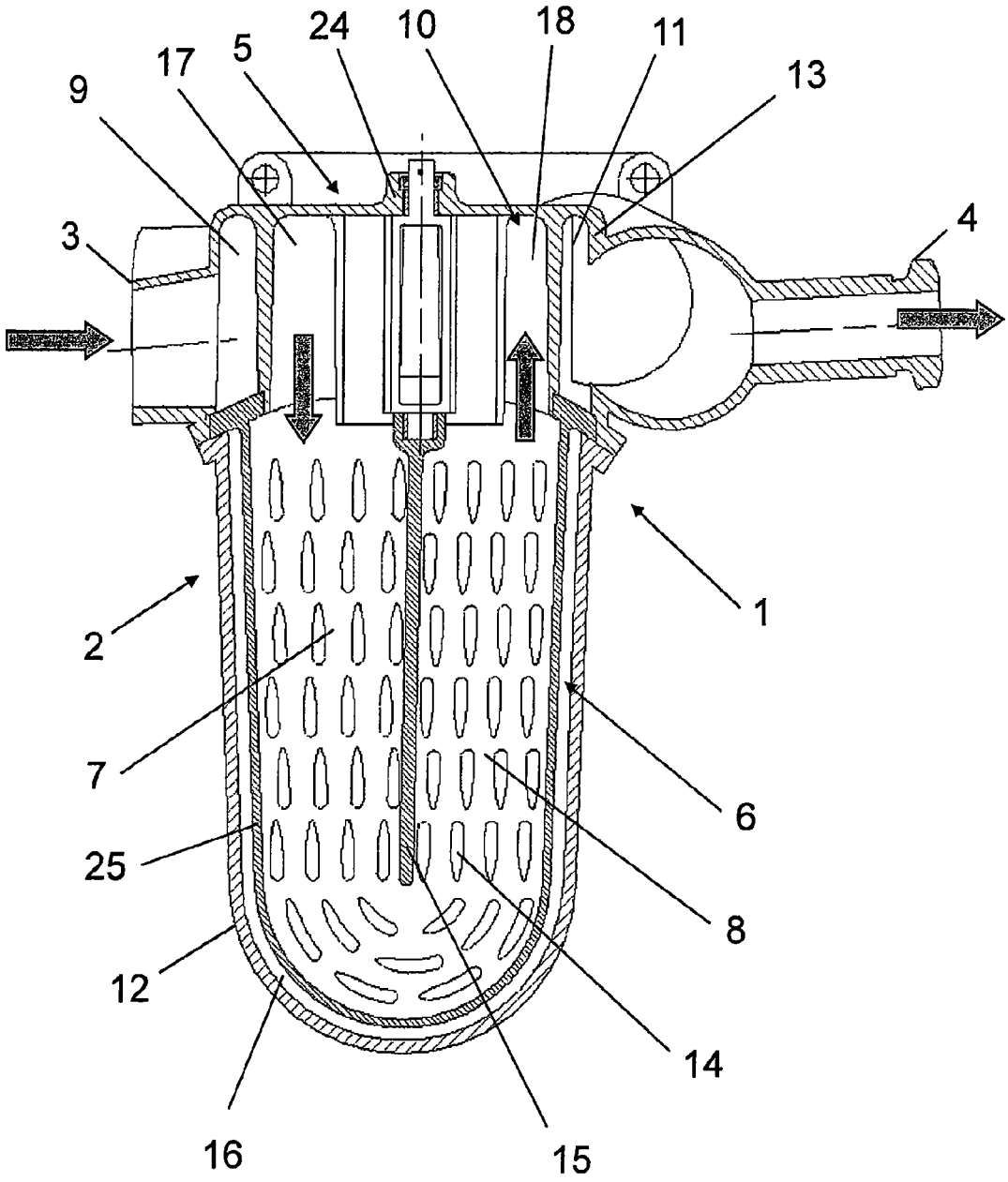
FIG. 1 is a sectional view of the exhaust-gas cooling device according to the present invention.

FIG. 1 illustrates the exhaust-gas cooling device 1 according to the present invention. As shown, there is provided a housing 2 which substantially consists of two housing shells 12,13, a first housing shell 12 of the housing shells 12,13 accommodating a heat exchange unit 6 and the second housing shell 13 having a valve device 5 supported therein. Further, the second housing shell 13 is provided with an exhaust-gas inlet 3 and an exhaust-gas outlet 4. The heat exchange unit 6 is of a U-shaped configuration and includes an outbound flow path 7 and a return flow path 8. In the case illustrated herein, heat exchange unit 6 consists of a bottom portion 25 and a cover (not illustrated). In the present embodiment, the bottom portion 25 and cover are in a known manner provided with surrounding ribs 14 which are effective to safeguard an improved heat transition between the exhaust gas in the outbound and return flow paths 7,8 and the coolant in the coolant enclosure 16. The outbound and return flow paths 7,8 are formed by a central wall 15 of the U-shaped heat exchange unit 6 that is arranged in a known manner. In the present embodiment, the central wall 15 also serves as a support site 24 for valve device 5. For reasons of clarity, a coolant inlet and a coolant outlet are not illustrated in the sectional view of FIG. 1.

The second housing shell 13 is configured to provide a first chamber 9, a second chamber 10 and a third chamber 11. The first chamber 9 provides a fluid connection from the exhaust-gas inlet 3 to the second chamber 10. The third chamber 11 provides a fluid connection from the second chamber 10 to the exhaust-gas outlet 4. Apart from the above connections, the second chamber 10 is provided with a connection to the outbound flow path 7 and a connection to the return flow path 8 of the U-shaped heat exchange unit 6. The valve device 5 is arranged in the second chamber 10 in such a manner that the second chamber 10 can be divided into two partial chambers 17,18, a first one 17 of the partial chambers 17; 18 being arranged in fluid connection with the outbound flow path 7, and the second partial chamber 18 being arranged in fluid connection with the return flow path 8.

Figure 2:
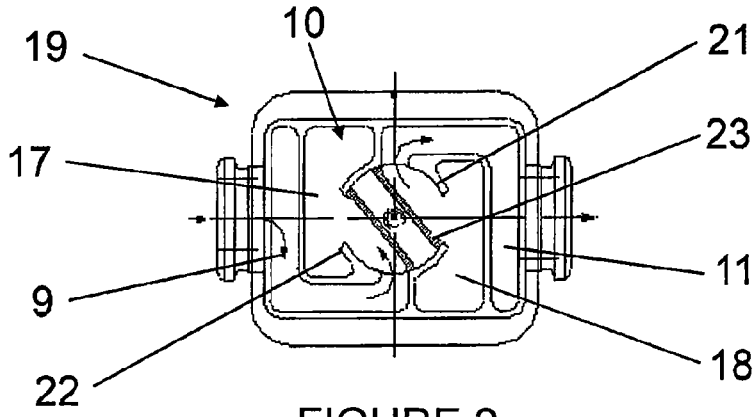
FIG. 2 is a front view of the valve device of the exhaust-gas cooling device of the invention during the cooling operation.
Figure 3:
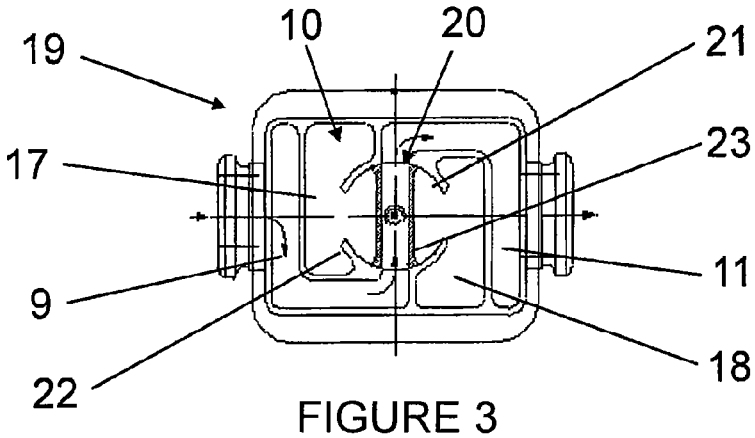
FIG. 3 is a front view of the valve device of the exhaust-gas cooling device of the invention in the bypass position.
Figure 4:
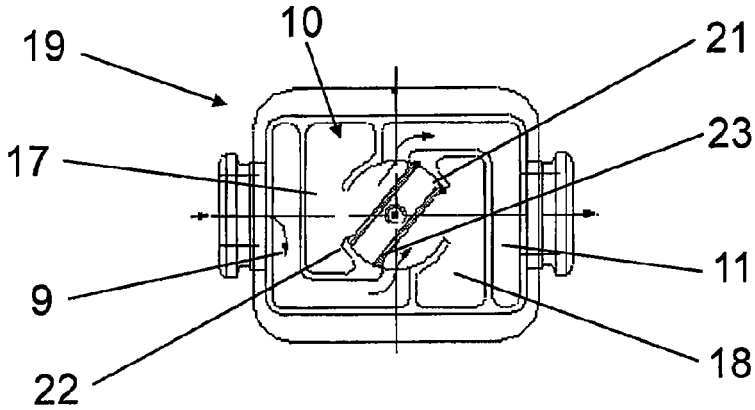
FIG. 4 is a front view of the valve device of the exhaust-gas cooling device of the invention in the cleaning mode.

A special embodiment and the operating principle of the exhaust-gas cooling device and respectively of an exhaust-gas recirculating system for an internal combustion engine can be derived from FIGS. 2 to 4. FIG. 2 is a sectional front view of the inventive exhaust-gas recirculating system 19 which, apart from the inventive exhaust-gas cooling device, comprises an exhaust-gas recirculation valve (not illustrated) arranged upstream relative to the flow direction, as well as a bypass channel 20 for bypassing the heat exchange unit 6, wherein the bypass channel 20 is highly preferably integrated into the valve device 5. In this arrangement, the valve device 5 is configured as a centrally supported flap valve, with one flap 23 being operatively connected to part-circular outer surfaces 21 and 22 of the first chamber 9 and respectively the third chamber 11 in such a manner that, depending on the position of flap valve 5, the first chamber 9 will be connected via partial chamber 17 to the outbound flow path 7 or via partial chamber 18 to the return flow path 8. In the example illustrated in FIG. 2, the flap valve 5 has been moved into a position causing the exhaust gas to flow via exhaust-gas inlet 3 into the first chamber 9 and from there, via partial chamber 17, through the outbound flow path 7 and subsequently through the return flow path 8 so as to be cooled, before the exhaust gas will enter the partial chamber 18 and then flow into the third chamber 11 and finally leave the exhaust-gas recirculating system via exhaust-gas outlet 4.

FIG. 3 again is a front view of the inventive exhaust-gas recirculating system 19 wherein, however, the flap valve 5 has been selected to cause a flow through bypass channel 20, so that the U-shaped heat exchange unit 6 will be bypassed. For this purpose and according to a special embodiment, bypass channel 20 is formed within flap 23 of valve device 5. In bypass operation, bypass channel 20 is directly connected to first chamber 9 and third chamber 11; as a result, the exhaust gas will flow along the shortest possible path from an exhaust-gas inlet 3 to exhaust-gas outlet 4 without being cooled. It should be evident that, of course, the option exists to not integrate the bypass channel into valve device 5. In this case, the bypass channel would be arranged externally of the valve device and would be opened and closed by a suitable bypass valve.

FIG. 4 is a front view of the exhaust-gas recirculating system 19 of the invention wherein the flap valve of valve device 5 has been moved into a position causing the exhaust-gas inlet 3 to be directly connected to the return flow path 8 via first chamber 9. Consequently, outbound flow path 7 is connected to exhaust-gas outlet 4 via third chamber 11. This setting allows for a particularly advantageous method for cleaning the U-shaped heat exchange unit 6. The hot exhaust gas will enter the first chamber 9 via exhaust-gas inlet 3 and will then be guided via partial chamber 18 into outbound flow path 7 in which, due to the high temperatures of the exhaust gas, sooting and cooled exhaust-gas residues adhering to the ribs 14,15 can be dissolved. Also in this case, the hot exhaust gas is cooled by the heat exchange unit 6 and will then be conveyed via outbound flow path 7 to exhaust-gas outlet 4.

Although the invention has been described and illustrated with reference to specific illustrative embodiments thereof, it is not intended that the invention be limited to those illustrative embodiments. Those skilled in the art will recognize that variations and modifications can be made without departing from the true scope of the invention as defined by the claims that follow. It is therefore intended to include within the invention all such variations and modifications as fall within the scope of the appended claims and equivalents thereof.

The invention claimed is:

1. An exhaust-gas cooling device for an internal combustion engine, said exhaust-gas cooling device comprising:

(a) a housing provided with an exhaust-gas inlet and an exhaust-gas outlet, wherein the housing further comprises a first chamber, a second chamber and a third chamber;

(b) a U-shaped heat exchange unit provided with an outbound flow path and a return flow path, wherein the first chamber, the second chamber and the third chamber of the housing are disposed on an open side of the U-shaped heat exchange unit; and (c) a valve device that comprises a centrically supported flap valve that, depending on a position of the flap valve, connects the exhaust-gas inlet to the outbound flow path or to the return flow path of the U-shaped heat exchange unit; wherein the first chamber provides a first fluid connection between the exhaust-gas inlet and the second chamber, and the third chamber provides a second fluid connection between the second chamber and the exhaust-gas outlet, and the valve device is arranged in the second chamber so that the second chamber is divided into at least two partial chambers, wherein a first partial chamber of the at least two partial chambers is arranged in fluid connection with the outbound flow path, and a second partial chamber of the at least two partial chambers is arranged in fluid connection with the return flow path, wherein the flap valve comprises a flap that is operatively connected to move on semi-circular surfaces that extend into the second chamber, wherein the flap includes a bypass channel formed therein, wherein when the flap is in a bypass position, the flap is arranged on the semi-circular surfaces so that the bypass channel is directly connected to the first chamber and to the third chamber so exhaust gas flow bypasses the U-shaped heat exchanger unit.

2. The exhaust-gas cooling device according to claim 1, wherein the flap is also operatively connected to semi-circular outer surfaces of said first and third chambers.

3. The exhaust-gas cooling device according to claim 1, wherein said housing further comprises two housing halves, wherein a first half of said housing halves accommodates said heat exchange unit and the second half of said housing halves has said valve device supported therein.

4. An exhaust-gas recirculation system for an internal combustion engine provided with an exhaust-gas cooling device according to claim 1.

5. A method for cleaning a U-shaped heat exchange unit of an exhaust-gas recirculation system, wherein the method comprises the steps of:

in the cleaning mode, connecting a return flow path to an exhaust-gas inlet of the U-shaped heat exchange unit so that a flow direction of exhaust gas through the U-shaped heat exchange unit is reversed; and subjecting the return flow path of the U-shaped heat exchange unit to hot exhaust gas due to reversal of the flow direction of the exhaust gas through the U-shaped heat exchange unit, wherein a valve device is used to connect the return flow path to the exhaust gas inlet in the cleaning mode, wherein the valve device comprises a centrically supported flap valve that, depending on a position of the flap valve, connects the exhaust-gas inlet to an outbound flow path or to the return flow path of the U-shaped heat exchange unit, wherein the valve device is arranged in a housing that includes a first chamber, a second chamber and a third chamber, wherein the first chamber provides a first fluid connection between the exhaust-gas inlet and the second chamber, and the third chamber provides a second fluid connection between the second chamber and an exhaust-gas outlet, and the valve device is arranged in the second chamber so that the second chamber is divided into at least two partial chambers, wherein a first partial chamber of the at least two partial chambers is arranged in fluid connection with the outbound flow path, and a second partial chamber of the at least two partial chambers is arranged in fluid connection with the return flow path, wherein the flap valve comprises a flap that is operatively connected to move on semi-circular surfaces that extend into the second chamber, wherein the flap includes a bypass channel formed therein, wherein in the cleaning mode the flap is arranged on the semi-circular surfaces so that hot exhaust gas enters the first chamber via the exhaust-gas inlet and without entering the bypass channel, and the hot exhaust gas is then guided via the second partial chamber into the outbound flow path so that a plurality of ribs of the U-shaped heat exchange unit are cleaned.

6. A method according to claim 5, wherein the plurality of ribs are cleaned by dissolving sooting and exhaust-gas residues at a high temperature of the hot exhaust gas.

* * * * *